United States Patent [19]

Brugger et al.

[11] 4,171,900

[45] Oct. 23, 1979

[54] COPYING MACHINE

[76] Inventors: Richard D. Brugger, 5433 Clinton Dr., Erie, Pa. 16509; Charles L. Lovercheck, 2319 South Shore Dr., Erie, Pa. 16505

[21] Appl. No.: 808,288

[22] Filed: Jun. 20, 1977

Related U.S. Application Data

[63] Continuation-in-part of Ser. No. 557,973, Mar. 13, 1975, Pat. No. 4,030,823.

[51] Int. Cl.[2] ..... G03G 15/00

[52] U.S. Cl. ..... 355/3 DD; 118/657; 118/658

[58] Field of Search ..... 355/3 DD, 3 R; 118/657, 118/658; 427/18

[56] References Cited

U.S. PATENT DOCUMENTS

| | | | |
|---|---|---|---|
| 3,176,652 | 4/1965 | Mott et al. | 118/658 |
| 3,392,432 | 7/1968 | Naumann | 188/657 X |
| 3,831,933 | 8/1974 | Fantozzi | 355/3 R |
| 3,923,391 | 12/1975 | Washio et al. | 355/3 R |

*Primary Examiner*—R. L. Moses
*Attorney, Agent, or Firm*—Charles L. Lovercheck

[57] ABSTRACT

A xerography type copy machine is disclosed. The machine has a photo conductor and a brush covered with a flexible sheet material for applying powdered material to the photo conductor of said xerography type machine. The flexible material contains particles of a permanently magnetized material, encapsulated in the flexible sheet. A permanent bar magnet is supported adjacent the flexible sheet on the side thereof remote from the photoconductor. The permanent magnet has a pole extending perpendicular to the direction of travel of the sheet so that when the magnetic field from the bar magnet passes through the laterally extending magnetic poles of the sheet, it alternately aids and opposes the field of the magnets on the sheet thereby causing the magnetic particles attracted to the sheet to bristle out and retract back to the sheet thereby causing the powder to form bristles which brush against the photo conductor and allow toner to be attracted to the charged parts of the photo conductor to form an image.

8 Claims, 4 Drawing Figures

COPYING MACHINE

REFERENCE TO PRIOR APPLICATION

This application is a continuation-in-part of patent application Ser. No. 557,973 filed Mar. 13, 1975 now U.S. Pat. No. 4,030,823, in the name of Richard D. Brugger, et al.

GENERAL DESCRIPTION OF THE INVENTION

This disclosure relates to optics and traverse mechanism and a magnetic brush. An improved mechanism involves optics, traverse and clutch for traverse (mechanisms), and photo conductor attachment is disclosed. This combination includes starting with the original document to be copied, scanning it to project it by means of the optics onto the photo conductor, where a latent image is caused to exist.

This combination of elements, made up of the magnetic brush, hopper, and toner supply, develops the latent image to a real image on the photo conductor. This application contains a more complete description of the magnetic brush, cross-section of magnetic rubber, showing material distribution near and away from the fixed magnet, and the generalization of "bristles", which really look more like paddle-wheel blades than bristles. Also a more complete description of the hopper and the toner holder is shown. A practical toner bottle is provided which is disposable and is much easier to use than other toner containers. The bottle becomes the toner-holder in the operating system.

The paper transport uses a paper supply, chute from supply to transport and the air transporting of paper. A nylon filament and O-ring belt assembly is disclosed.

The cabinet is a pull out, with easy access to internal working parts.

The machine, according to the invention, will be made in accordance with the parent application from a suitable frame and cabinet and light system. The drum, coronatrons, light passage, paper transport, toner dispenser and magnetic brush will be supported on the frame in a manner shown in the parent application. A photo conductor will be supported on the outer periphery of the drum, and the charging coronatron will be supported as shown when the drum rotates in a counterclockwise direction when viewed as shown in FIG. 1. The charging coronatron will be of a type familiar to those skilled in the art having a high voltage wire adjacent the drum. The light means is adapted to project an image from a document or the like onto the drum in a manner described in the parent application and the paper transport means is provided for carrying the paper passed the drum. The toner dispenser is supported adjacent the drum and the magnetic brush adjacent the drum for depositing toner on the charged drum.

The transfer coronatron is supported adjacent the paper on the side thereof remote from the drum and the paper being carried down the transport has the toner from the drum transferred to the paper in a manner familiar to those skilled in the art. The magnetic brush comprises a cylindrical member made of mon-magnetic material which is rotatably supported around the shaft which extends through the cylindrical member and the shaft is supported against the rotation. A permanent bar magnet is supported on the shaft. The bar magnet has a pole adjacent the inner periphery of the cylinder and the sheet of flexible material in the outer periphery of the cylinder has particles of magnetic material such as barium ferrite. This barium ferrite material is polarized such that the poles extend from one side of the sheet to the other parallel to the shaft and the poles are spaced apart approximately one-eighth inch so that the field between these poles, which alternate north, south, north, south, around the outer circumference of the brush extend from one side of the cylinder to the other. The bar magnet, being adapted to alternately oppose and aid the fields from the poles of the particles so that the toner material, that is carried by the brush, bristles outward in the area of the bar magnet and retracts when the particular poles pass the bar magnet, thus, providing bristles on the magnetic brush.

OBJECTS OF THE INVENTION

It is an object of the invention to provide an improved xerography type copying machine.

Another object of the invention is to provide an improved magnetic brush in a copying machine.

Another object of the invention is to provide an improved paper transport in a copying machine.

Another object of the invention is to provide a magnetic brush for a copying machine that is simple in construction, economical to manufacture and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
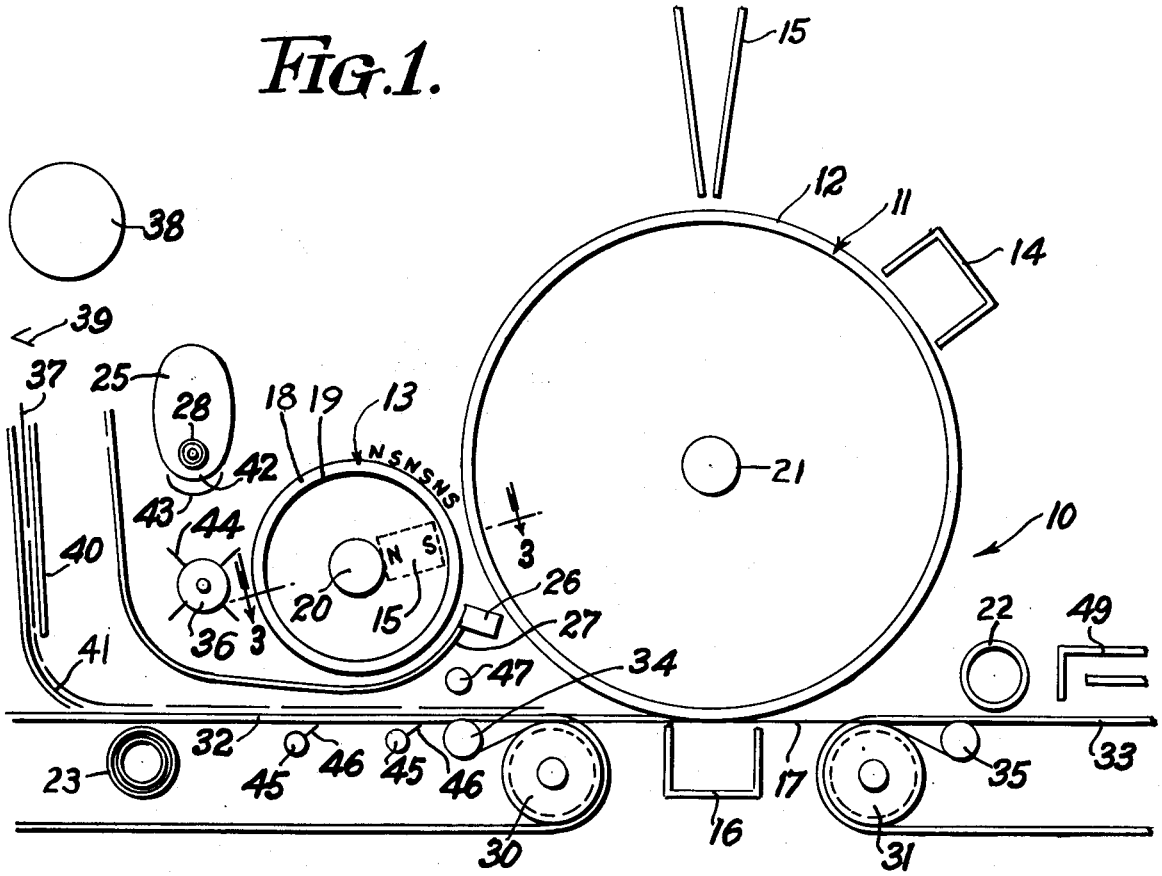
FIG. 1 is a diagrammatic view of the essential parts of a copying machine according to the invention.
Figure 2:
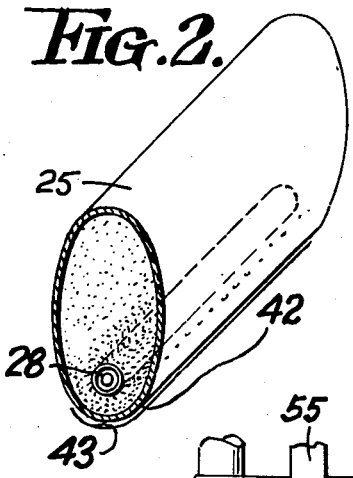
FIG. 2 is an enlarged view of the toner dispenser for the copying machine according to the invention.
Figure 3:
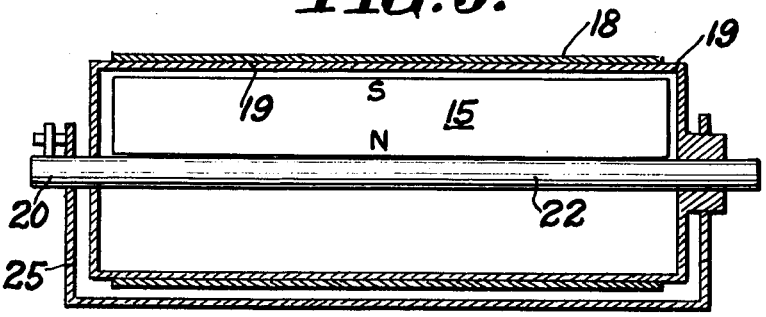
FIG. 3 is a longitudinal, cross-sectional view of the magnetic brush taken on Line 3—3 of FIG. 1.
Figure 5:
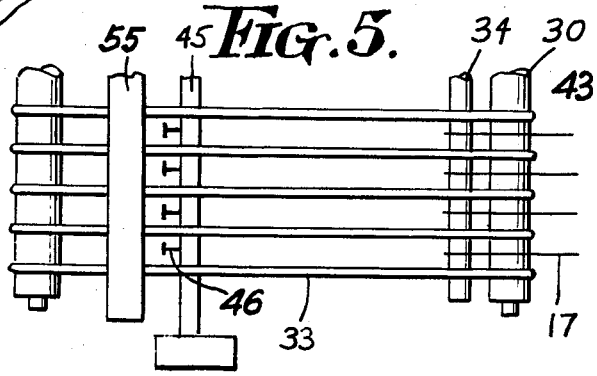
Figure 4:
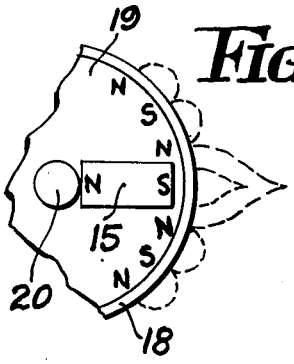
FIG. 4 is a diagrammatic view showing the magnetic fields from the "magnetic rubber" induced by the permanent magnet.

Now, with more particular reference to the drawings, the diagram of the xerography machine 10 shown in FIG. 1, a shaft is rotatably supported on the machine and it extends traversely thereof and is driven by a suitable motor. The shaft carries the drum 11 which may have a suitable cylindrical outer periphery on which the photo conductor 12 may be supported. The photo conductor 12 may have either a sheet of photo conductor material or a coating on the external surface.

A charging coronation 14 is supported adjacent the outer periphery of the drum and a transfer coronaton 16 is supported below the nylon threads 17. The magnetic brush 13 is rotatably supported adjacent the drum 11. The permanent bar magnet 15 is held in position on shaft 20 adjacent the inside periphery of the drum 19 and the sheet of flexible material 18 carried on the non-magnetic drum 19 provides a series of magnetic fields around its outside. The drum 19 is freely rotatable on the shaft 20 which is held on the machine against rotation and as the small magnetic fields from the flexible material pass through the magnetic field from the bar magnet, the fields are successively aided and blocked.

The rollers that carry the paper transport comprise a first pair of rollers 30 and a second pair of rollers 31. First belts 32 pass around the first rollers 30 and second belts 33 pass around the second rollers 31. The first rod 34 extends between the belt 32 and has its ends fixed to the machine. Second rod 35 extends through the loop of the belt 33 and its ends are fixed to the side of the machine and the nylon thread 17 is laced around rods 34 and 35 and extend back and forth in criss-cross fashion between the transfer coronatron 19 and the drum 12 providing a path between the drum and the nylon thread for the paper 37 to pass. The paper 37 is cut from the roll 38 by paper cutter 39 and the paper falls by gravity through a chute 40 down around the curve 41 to the top of the first belt 32.

The container 25 may be a plastic bottle with the bristle brush 28 inside it. The plastic bottle 25 has holes 42 in its lower side which may be covered by a pressure-sensitive tape 43 for shipping purposes. The agitator is in the form of a shaft driven from the machine having pins 44 extending outwardly from it.

A paper lift rod has laterally spaced pins 46 on them and when the rods 45 are rotated in a counter-clockwise direction, the pins engage the paper sheet and lift it off of the belt 32. When the rods 45 are rotated in a clockwise direction, the pins 46 are swung downwardly out of engagement with the paper and the paper drops onto the belts 32 and is carried forward toward the photo conductor. A positive pressure may be put on the paper by means of air from the spaced holes in pipe 47 which has a row of holes in its lower side. The flow of air from this pipe may be timed so that it engages the paper at exactly the correct time when the rods 45 are rotated to lower the paper onto the belt 32. When the paper is carried past the drum 11, the toner from the drum is transferred to the paper and as it passes below the fuser 49, which may be equipped with electric heaters or other suitable heating means, the toner is fused to the paper. Various parts of the machine will be interconnected by a suitable control circuit to provide the correct sequence of operation of the several parts.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A xerography type copy machine comprising,
a photo conductor,
a brush supported adjacent said photo conductor for applying a fusible powder to said photo conductor,
said brush comprising a drum made of non-magnetic material, a sheet of flexible, non-magnetic material containing permanently magnetized particles disposed around said drum,
means supporting said flexible material on said machine adjacent said photo conductor and means to move said sheet of flexible material relative to said photo conductor in close, spaced proximate relation thereto,
said permanently magnetized particles being magnetized to provide alternate magnetic pole means on said flexible sheet extending perpendicular to the path of movement of said sheet,
a permanent bar magnet means supported on said machine on the side of said flexible sheet remote from said photo conductor,
said permanent magnet having a first pole adjacent said first sheet extending perpendicular to the path of movement of said sheet in close, spaced relation to said sheet,
whereby said spaced poles of said flexible sheet pass through the flux from said pole of said permanent magnet alternately aiding and blocking the field from said spaced magnetic poles on said flexible sheet,
whereby said powdered material attracted to said flexible sheet is caused to alternately bristle out toward said photo conductor and retract away from said photo conductor thereby causing said powder to engage said photo conductor and means to doctor the surface thereof with said powdered material.

2. A xerography type copy machine comprising,
a photo conductor,
a brush supported adjacent said photo conductor for applying a fusible powder to said photo conductor,
said brush comprising a drum made of non-magnetic material, a sheet of flexible, non-magnetic material containing permanently magnetized particles disposed around said drum,
means supporting said flexible material on said machine adjacent said photo conductor and means to move said sheet of flexible material relative to said photo conductor in close, spaced proximate relation thereto,
said permanently magnetized particles being magnetized to provide alternate magnetic pole means on said flexible sheet extending perpendicular to the path of movement of said sheet,
a permanent bar magnet means supported on said machine on the side of said flexible sheet remote from said photo conductor,
said permanent magnet having a first pole adjacent said first sheet extending perpendicular to the path of movement of said sheet in close, spaced relation to said sheet,
whereby said spaced poles of said flexible sheet pass through the flux from said pole of said permanent magnet alternately aiding and blocking the field from said spaced magnetic poles on said flexible sheet,
whereby said powdered material attracted to said flexible sheet is caused to alternately bristle out toward said photo conductor and retract away from said photo conductor thereby causing said powder to engage said photo conductor and means to doctor the surface thereof with said powdered material,
spaced rollers on said machine move a sheet of material into engagement with said photo conductor, and said rollers comprise,
a first pair of rollers and a second pair of rollers,
first belt means on said first pair of rollers,
second belt means on said second pair of rollers, a paper storage means,
means to drop a sheet of paper from said paper storage means onto said first belt,
whereby said paper is transported adjacent said drum to said second belt, said first rollers have a first rod therebetween and said second rollers have a second rod therebetween, a thread passing around said first rod between said drum and said transfer coronatron over said second rollers to said second rod, whereby said paper is guided from said first belt means to said second belt means and to a fuser means on said machine.

3. A machine as in claim 2 wherein a paper chute is provided, said paper is dropped from said paper storage, through said paper chute to said first belt, whereby the paper is carried between said drum and said transfer coronatron and toner from said drum is transferred by electrostatic force from said second coronatron to said paper.

4. A machine as in claim 3 wherein a thread is passed around said rods a plurality of times providing a criss-cross web between said rods.

5. A machine as in claim 4 wherein a hopper is provided on said machine and said brush is supported in said hopper and agitating means is provided for directing said toner toward said magnetic brush.

6. A machine as in claim 5 wherein means is provided on said machine adjacent said first belt means for causing said paper sheet to dwell at said first belt means, dwell means for causing said dwell comprising, a rod extending traversely of said machine having arms thereon below said first belt means, means to rotate said rod bringing said arms into engagement with said paper for lifting said paper out of engagement with said first belt means.

7. A xerography type copy machine comprising a paper transport, including spaced rollers, said rollers comprise a first pair of rollers and a second pair of rollers, first belt means on said first pair of rollers, second belt means on said second pair of rollers, means to move a sheet of paper from said paper storage, means onto said first belt, whereby said paper is transported the position adjacent said drum to said second belt, an air pipe is supported above second belt, spaced holes are in said air pipe and means are provided for directing air through said air pipe onto said paper supported on said first belt means, whereby said paper is held to said belt to move therewith, means for turning air to said air pipe on and off selectively in sequence with the rotation of said drum, drum rotatably supported on said machine, a photo conductor on said drum, charging means supported adjacent said drum for charging said photo conductor, light means adapted to project an image on said drum, paper transport means for carrying paper past said drum, toner dispensing means adjacent said drum and a magnetic brush supported adjacent said drum for depositing toner on said drum from said toner dispenser, and transfer means adjacent said paper transport for transferring toner from said drum to said paper, a magnetic brush comprising, a cylindrical member made of non-magnetic material, a shaft extending through said cylindrical member, means supporting said shaft against rotation, a permanent magnet supported on said shaft, said permanent magnet having a pole adjacent the inner-periphery of said cylinder, said flexible sheet having particles of magnetic material imbedded therein, said particles being magnetized to form poles extending parallel to said shaft from one side of said sheet to the other, said poles being spaced from each other an amount equal to less than one-half radian of the circumference of said cylinder, said magnetic bar being adapted to project through said hollow cylinder to alternately oppose and aid the fields of said poles of particles whereby toner material carried by said brush bristles outwardly in the area of said bar magnet whereby bristles are formed excessively on said flexible material as said cylinder rotates.

8. A magnetic brush for a copying machine, said magnetic brush comprising a non-magnetic drum, a shaft extending through said drum, said drum being rotatable on said shaft, a permanent magnet supported on said shaft and magnetic rubber supported on the outside of said periphery of said drum providing a plurality of magnetic poles for attracting xerography toner thereto for providing a magnetic brush, said permanent magnet being adapted to influence the magnetic fields of said magnetic rubber to cause said toner to extend outwardly therefrom to form a brush.

* * * * *